US006375382B1

(12) United States Patent
Clavet

(10) Patent No.: US 6,375,382 B1
(45) Date of Patent: Apr. 23, 2002

(54) CRANK HANDLE ASSEMBLY FOR CASEMENT WINDOW

(76) Inventor: Alain Clavet, 6480 St-Joachim, Mirabel Quebec (CA), J0N 1S0

( * ) Notice: Subject to any disclaimer, the term of this patent is extended or adjusted under 35 U.S.C. 154(b) by 18 days.

(21) Appl. No.: 09/589,150

(22) Filed: Jun. 8, 2000

(51) Int. Cl.[7] ..... A47B 95/02
(52) U.S. Cl. ..... 403/359.5; 403/362; 16/429
(58) Field of Search ..... 403/362, 359.5; 74/547; 16/429

(56) References Cited

U.S. PATENT DOCUMENTS 4,615,236 A * 10/1986 Boots ..... 74/547 X
5,201,241 A * 4/1993 Pollack, Jr. ..... 74/547 X
5,410,778 A * 5/1995 Langevin ..... 74/547 X
5,802,673 A * 9/1998 Nemeth ..... 403/362 X

* cited by examiner

*Primary Examiner*—Lynne H. Browne
*Assistant Examiner*—John R. Cottingham
(74) *Attorney, Agent, or Firm*—George A. Seaby

(57) ABSTRACT

A compact, streamlined crank assembly for use on the splined shaft of a casement window operating mechanism includes a tubular body with an ovoid socket in the bottom thereof for mounting the body on any one of the shafts of various window operating mechanisms. A handle pivotally mounted on one corner of the body is stored in a trough on the top end of the body, or the handle includes a trough complementary to the square cross section top end of the body.

8 Claims, 7 Drawing Sheets

CRANK HANDLE ASSEMBLY FOR CASEMENT WINDOW

BACKGROUND OF THE INVENTION

1. Field of the Invention

This invention relates to a crank assembly for use on a window operating mechanism.

More specifically, the invention relates to a crank assembly for use on the shaft of a casement window operating mechanism.

2. Discussion of the Prior Art

Crank handles for window opening and closing devices are disclosed. for example by U.S. Pat. Nos. 4,189,248, issued to G. R. Sully on Feb. 19, 1980, 5,168.770, issued to F. G. Ellis on Dec. 8, 1992; 5,400,473, issued to G. S. Delman on Mar. 28, 1995; 5,410,778, issued to Y. Langevin on May 2, 1995; 5,467,503, issued to D. A. Nolte et al on Nov. 21, 1995; 5,551,316, issued to J. L. Blank on Sep. 3, 1996 and 5,802,673, issued to J. Nemeth on Sep. 8, 1998. As clearly illustrated by some of these patents, a crank handle is mounted on a splined shaft, which is rotated to operate a lever to open or close a window. Various efforts have been made to make such handles more streamline, because a handle projecting outwardly form a window operating mechanism is somewhat obtrusive. interfering with the opening and closing of curtains or blinds. An obvious solution to the problem is to make the handle foldable for storage in a non-use position. Such a structure is proposed by the Delman, Langevin, Nolte et al, Blank and Nemeth patents. However, there still exists a need for a crank handle which while streamlined, can be easily moved between use and non-use positions. It is also important that the handle is stable during rotation, and provides maximum torque to facilitate window opening.

There are many different versions of window operating assemblies, i.e. assemblies having splined shafts which differ from each other in terms of length, diameter and spline configuration. Examples of such assemblies are available from Andersen Corporation, Bayport, Minnesota; Peachtree Doors, Inc., Norcross, Georgia: Pella Corporation, Pella. Iowa and Truth Hardware Corporation, Owatonna, Minn. The handles used to crank the different assemblies are unique to each model, i.e. they are not interchangeable. Moreover, for the most part the crank handles on available assembles are not foldable to a storage position.

GENERAL DESCRIPTION OF THE INVENTION

An object of the present invention is to provide a solution to the above-identified problems with existing devices in the form of a relatively simple, compact, streamline crank assembly for a window operating mechanism which includes a foldable handle., and which is universal. i.e. can be used on most if not all existing models of window operating mechanisms.

Accordingly, the invention relates to a crank assembly for use on a splined shaft operable to open and close a casement window comprising a tubular body having a closed top end and an open bottom end; a socket in said open bottom end for mounting the body on the splined shaft; a handle pivotal on one corner of said top end for rotation between an extended position in which the handle extends outwardly from the body for rotating the body and the splined shaft to open and close the window, and a stored position in which the handle extends across the top of the body, one of the top end of the body and the handle defining a trough or ridge; and the other said top end of the body or the handle defining a complementary ridge or trough, whereby in the stored position, with the trough and ridge mating, the bottom edge of the handle lies beneath the end of the body; and a knob on a free end of said handle, in the stored position, the knob being spaced apart from one end of the body for facilitating manual access to the knob and rotation of the handle to the extended, use position for rotating the body and the shaft.

BRIEF DESCRIPTION OF THE DRAWINGS

The invention is described below in greater detail with reference to the accompanying drawings, which illustrate a preferred embodiment of the invention, and wherein.

DESCRIPTION OF THE PREFERRED EMBODIMENT

Figure 1:
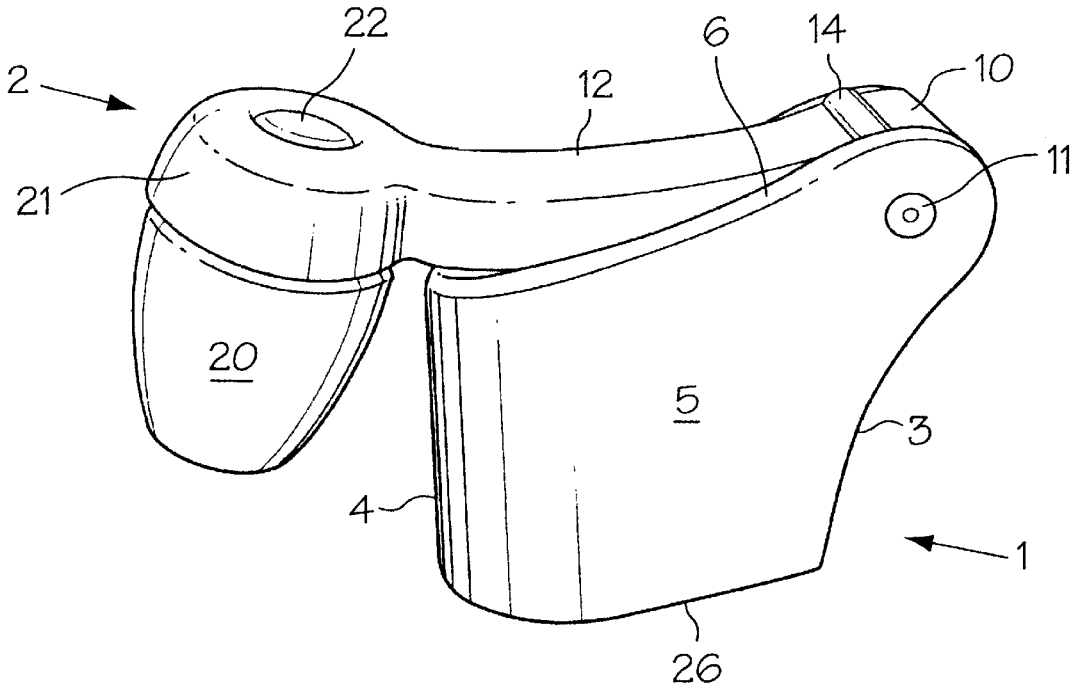
FIG. 1 is a perspective view of a preferred embodiment of the crank assembly in accordance with the present invention with a handle in a stored, non-use position.
Figure 2:
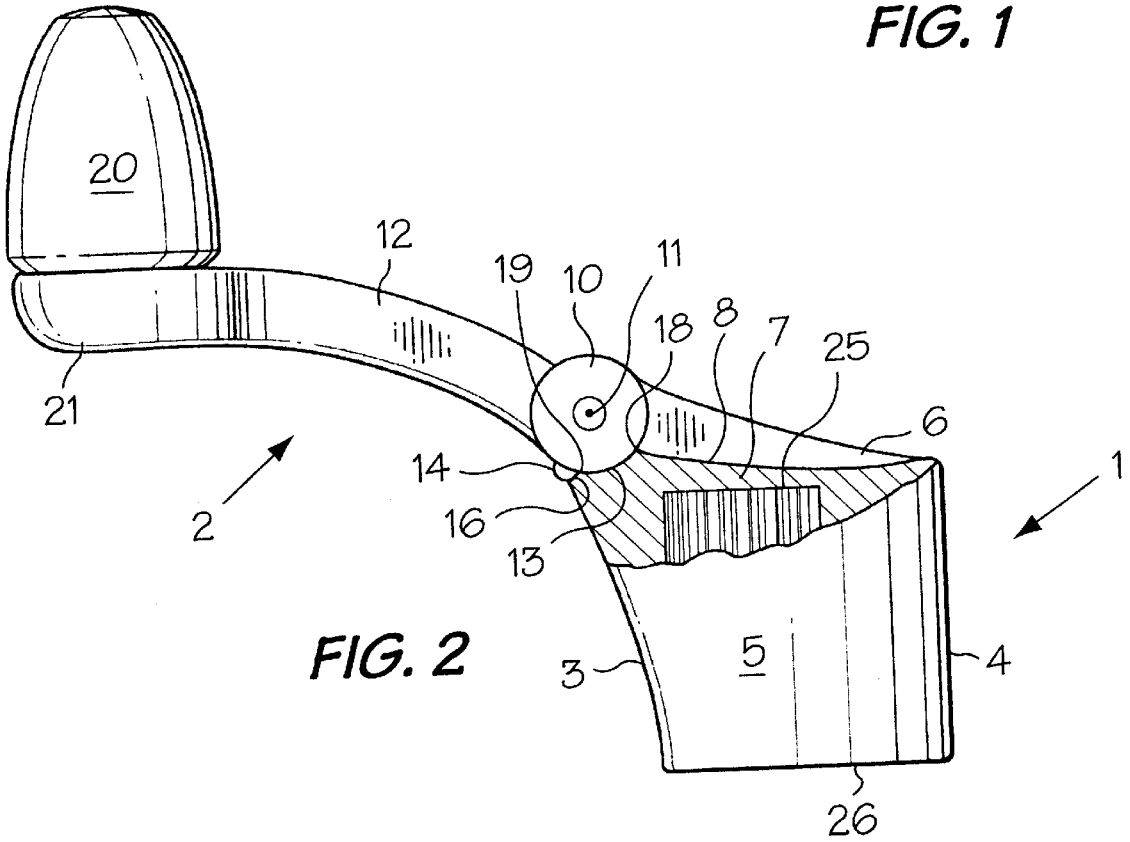
FIG. 2 is a view of the crank assembly of FIG. 1 with the handle in the extended, use position.
Figure 3:
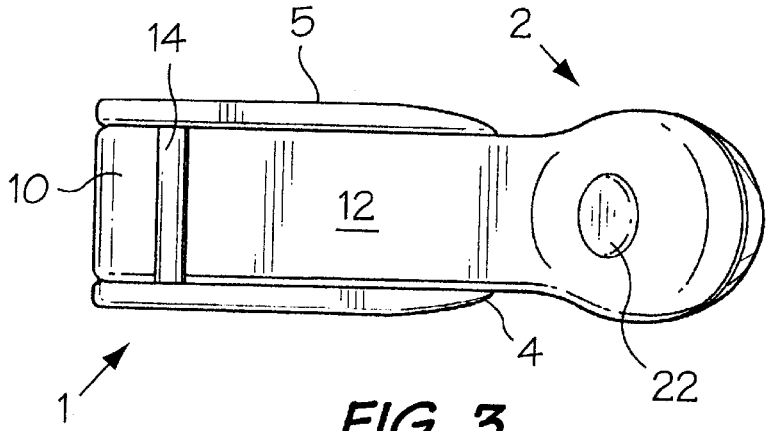
FIG. 3 is a top view of the crank assembly of FIGS. 1 and 2.
Figure 4:
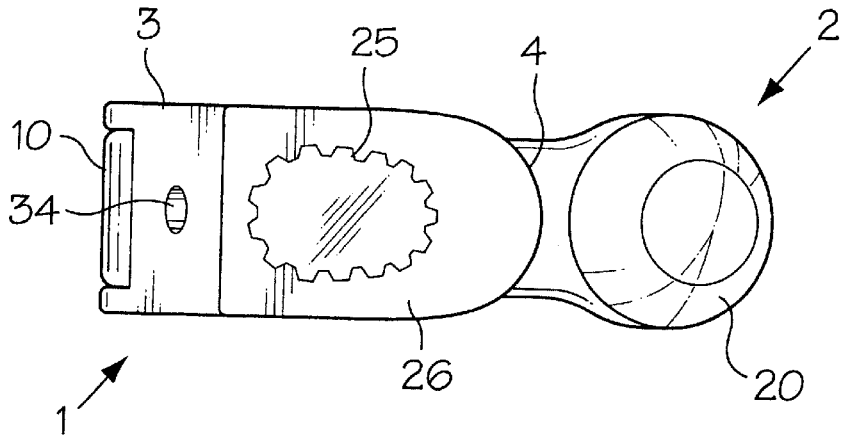
FIG. 4 is a bottom view of the handle assembly of FIGS. 1 and 2.

Referring to FIGS. 1 to 3, the basic elements of a crank assembly in accordance with the present invention include a solid body generally indicated at 1 and a handle generally indicated at 2.

The body 1 is generally rectangular in cross section with a flat or square end 3, a generally semicylindrical end 4, and straight, planar sides 5. A pair of flanges 6 extend upwardly from the top end 7 of the body defining a square cross section recess 8 for receiving the arcuate handle 2. As best shown in FIG. 2, the trough 8 tapers from the square end 3 to the semicylindrical end 4 of the body. The flanges 6 at the end 3 are generally semicircular, defining the sides of a bracket for receiving a transversely extending cylindrical inner end 10 of the handle 2. A pin 11 extending through the flanges 6 and the end 10 pivotally connects the handle 2 to the body 1 for rotation between a non-use or stored position (FIG. 1) and an extended, use position (FIG. 2). In the extended position. the handle 2 is used to rotate the body 1.

In the non-use position, a substantial portion of the rectangular body 12 of the handle 2 is bordered by the flanges 6. A concave, transversely extending groove or depression 13 at the handle end of the trough 8 acts as a bearing surface for the end 10 of the handle 2. Because the large cylindrical inner end 10 of the handle 2 has maximum surface area in contact with the semicircular flanges 6 of the trough, maximum torque is generated when the handle 2 is rotated. The large socket defined by the groove 13 and the flanges 6 results in maximum contact between the inner end 10 of the handle 2 and the body 1 during rotation of the handle 2. A transversely extending, convex projection 14 on the top of the cylindrical handle end 10 (in the non-use position) acts as a stop to limit rotation of the handle 2 towards the use position. As shown in FIG. 2., when the handle 2 is in the use position, the ridge 14 rests on a transversely extending shoulder 16 at the top corner of the square end of the body 1. Thus, the bottom of the trough 8 resembles a wave, with transversely extending peaks 18 and 19 bordering the depression 13.

A generally frusto-conical knob 20 with an arcuate outer surface is rotatably mounted on the circular outer free end 21 of the handle 2 by means of a bolt 22 with a large head. In the non-use position, the knob 20 is inclined downwardly and is spaced a short distance from the semicylindrical end 4 of the body 1. By grasping the knob end 21 of the handle 2, the latter is rotated around the axis of the pin 11 to the use position (FIG. 2) in which the handle 2 is used to rotate the body 1. In the use position, the outer end 21 of the handle 2 is substantially perpendicular to the vertical, longitudinal axis of the body 1 for providing maximum leverage during rotation.

Figure 6:
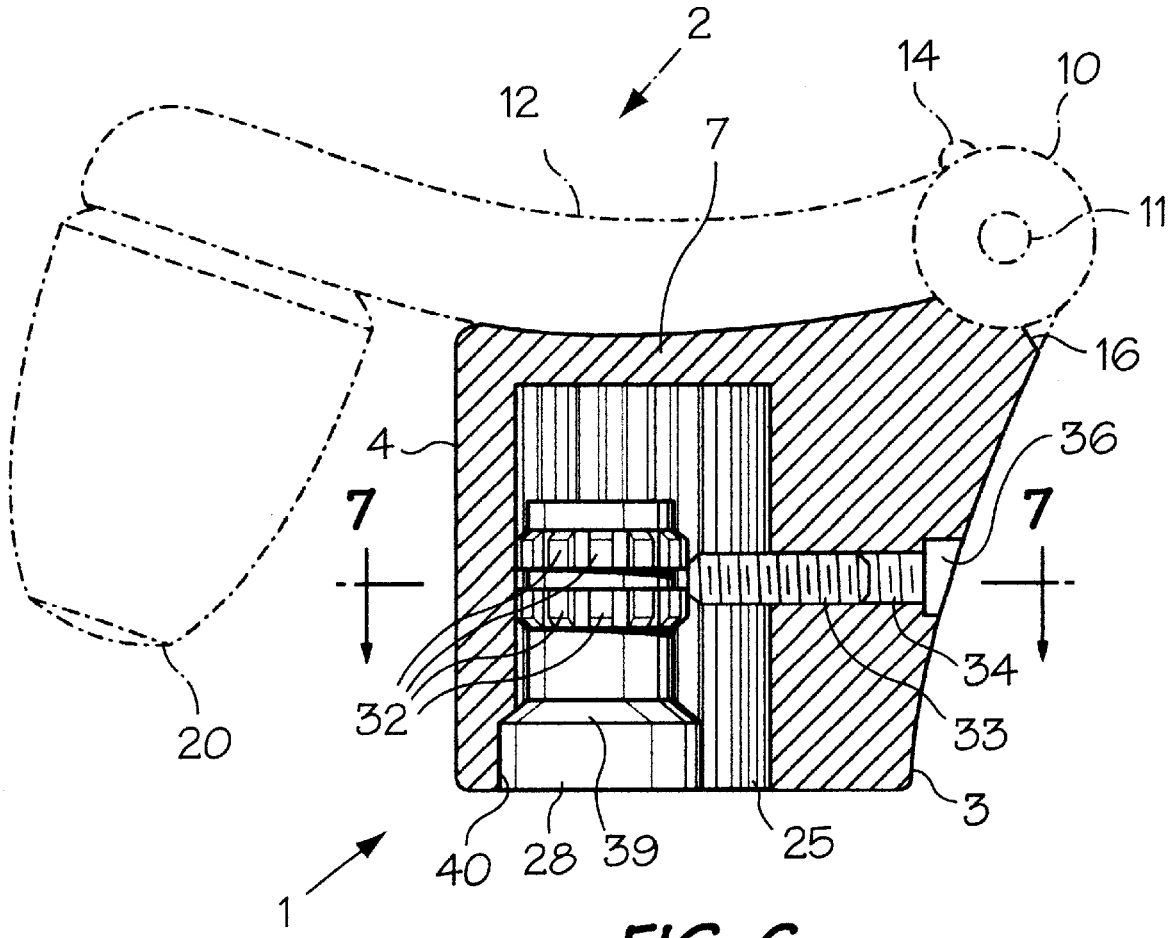
FIGS. 6, 8, 10 and 12 are longitudinally sectional views of the handle assembly of FIGS. 1 to 3 mounted on a variety of shafts of window operating mechanisms.
Figure 7:
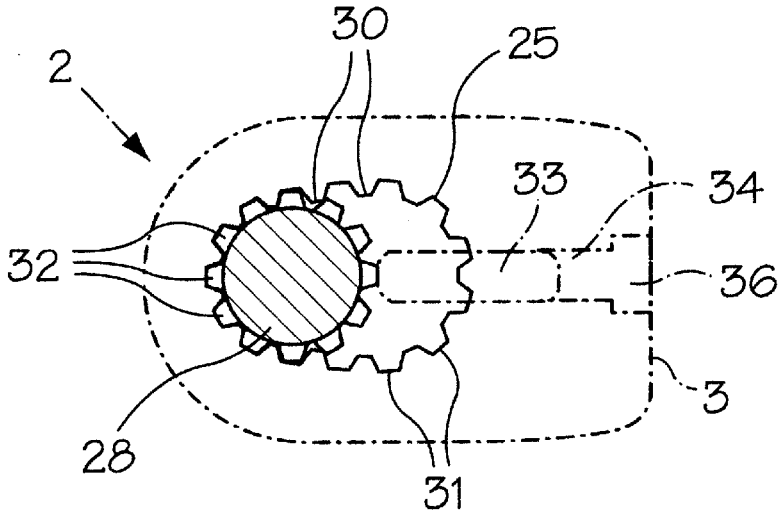
FIGS. 7, 9, 11 and 13 are cross sections taken generally along line 7—7 of FIG. 6, 9—9 of FIG. 8, 11—11 of FIG. 10 and 13—13 of FIGS. 12, respectively

With reference to FIGS. 2, 6 and 7, a socket 25, extends from the bottom end 26 of the body to a location proximate the closed top end 7 of the body 1. The socket 25, which is ovoid in cross section, is designed to receive the splined shaft 28 of a casement window operating mechanism (not shown), whereby the body 1 and the handle 2 can be used to rotate the shaft 28 to open and close the window. For such purpose, the sides and ends of the socket 25 are splined, i.e. include longitudinally extending, alternating ridges 30 and grooves 31 for engaging splines or teeth 32 on the shaft 28. The body 1 is secured on the shaft 28 by a set screw 33 (FIGS. 6 to 13) in a threaded bore 34 extending through the flat end 3 of the body to intersect the socket 25. The outer end 36 (see e.g. FIG. 6) of the bore 34 is countersunk to facilitate access to the screw 33.

Figure 5:
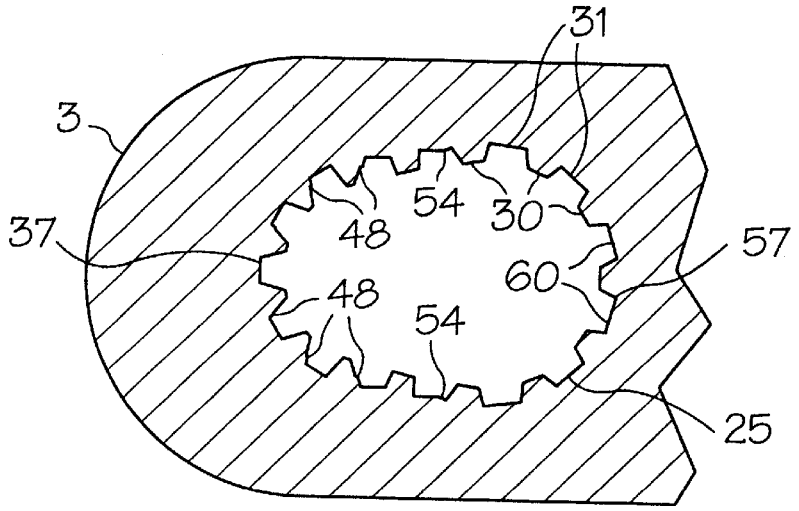
FIG. 5 is a schematic cross section of one end of the body of the handle assembly of FIGS. 1 to 3 on a larger scale.

Because of the existence of many different crank assemblies., i.e. crank assemblies having shafts of different lengths, diameters and spline configuration, in order to be universal, the socket 25 is adapted to receive and retain a variety of shafts. For such purpose, as mentioned above, the socket 25 is generally ovoid in cross section. As best shown in FIG. 5, the ovoid socket 25 includes a narrow end 37 for receiving a narrow diameter shaft 28 (FIGS. 6 and 7). Because the shaft 28 includes a tapering shoulder 39 (FIG. 6), an arcuate notch 40 is provided in the bottom end of the socket 25 for receiving the shoulder end of the shaft 28 limiting movement of the latter into the socket 25. The particular shaft 28 shown in FIGS. 6 and 7 has two annular rows of short teeth 32 with a pronounced taper. Accordingly the grooves 31 at the end 43 of the socket 25 (closest to the round end 4 of the body 1) are relatively deep with a taper corresponding to the taper of the teeth 32. Thus. (as best shown in FIG. 7) when the set screw 33 is tightened, a maximum number of the teeth 32 are engaged by the splines in the socket 25.

Figure 8:
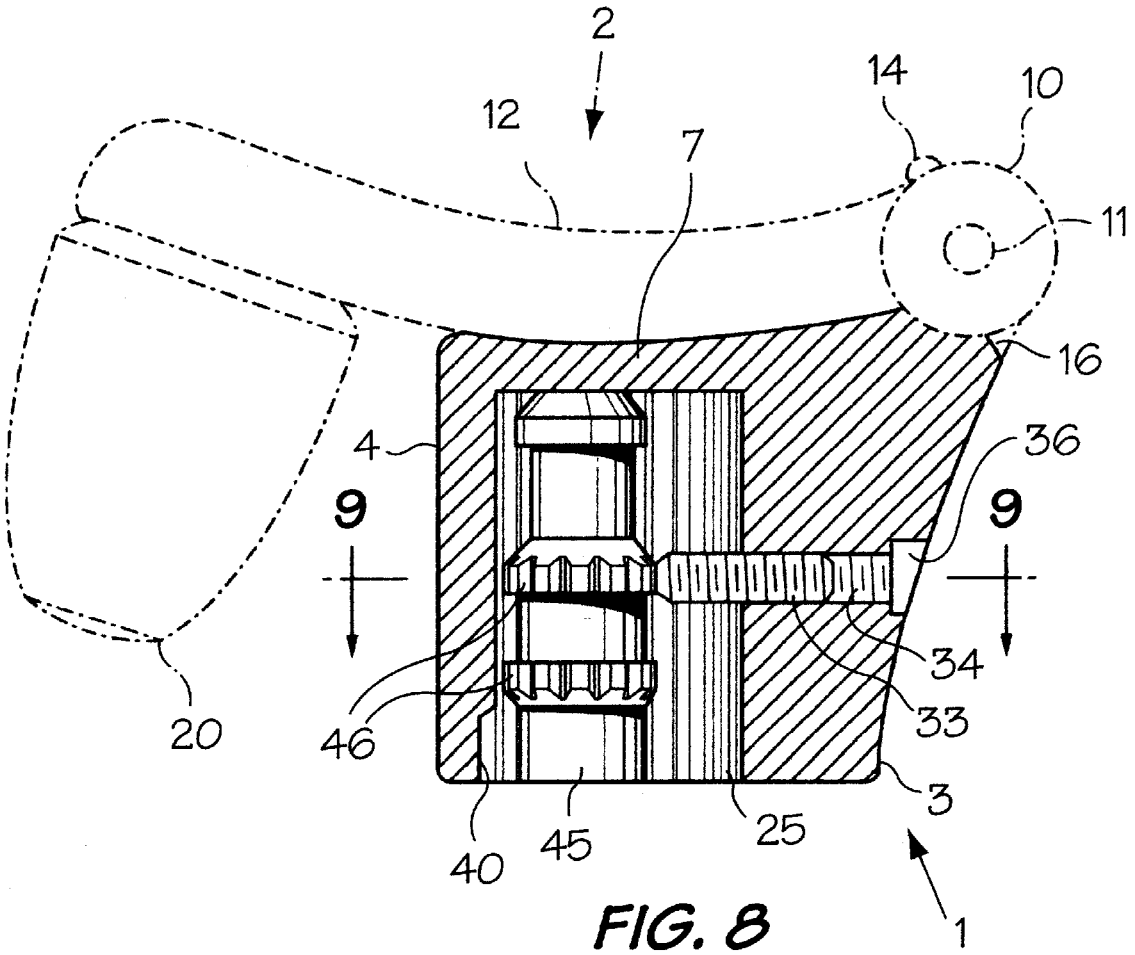
Figure 9:
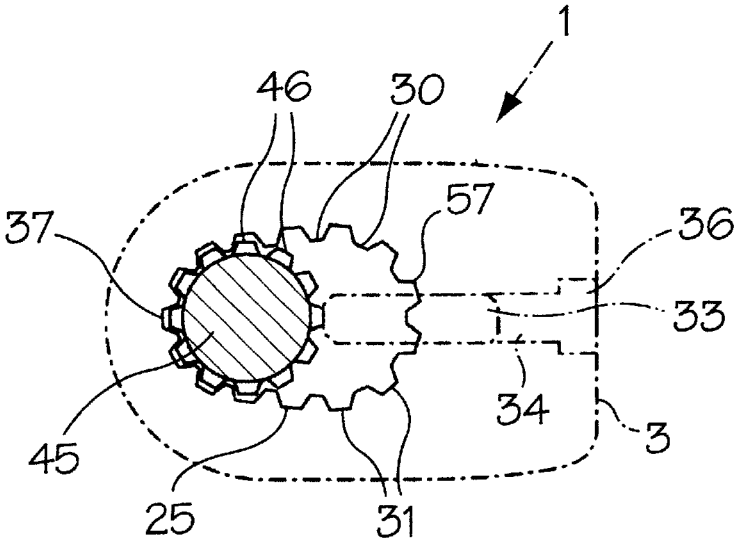
Figure 10:
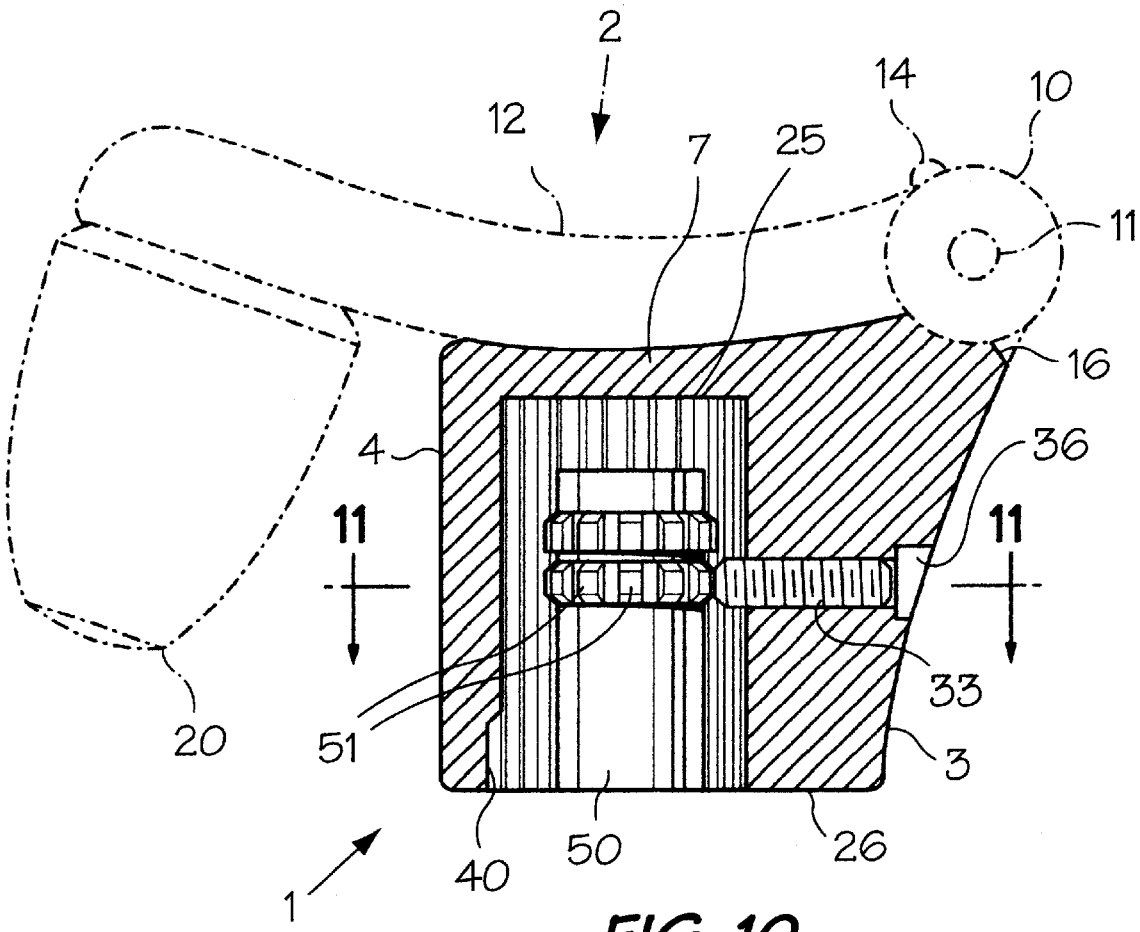

Referring to FIGS. 5, 8 and 9, a second form of shaft 45 from a commercially available crank assembly is longer than the shaft of FIGS. 6 and 7, and includes a pair of spaced apart, annular rows of teeth 46, which are shorter than the teeth 32 on the shaft 28. The diameter of the shaft 45 in the tooth area and the height and taper of the teeth 46 are such that the teeth do not fully enter the grooves 31 at the end 37 of the socket 25. Accordingly, steps or shoulders 48 (FIG. 5) are provided on the sides of some of the grooves 31 in the socket 25. The shoulders 48 ensure maximum engagement between the teeth 46 and the splines 30 in the socket 25 when the set screw 33 is tightened.

Figure 11:
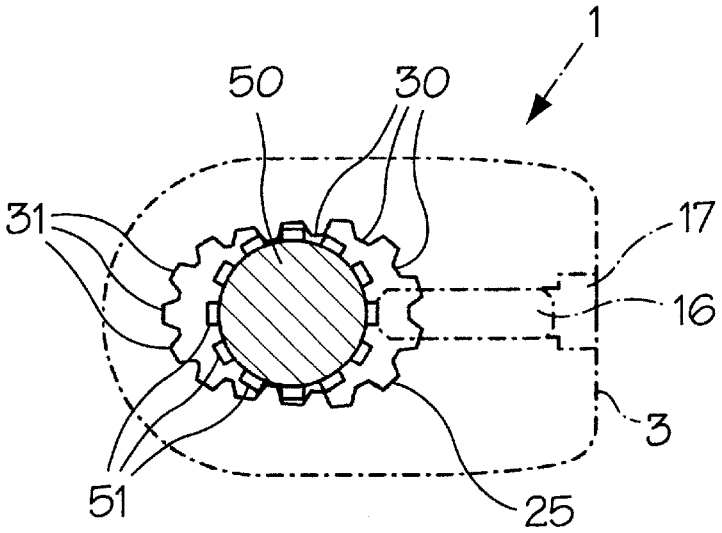

The cylindrical shaft 50 of a third version of a crank assembly (FIGS. 10 and 11) also includes a pair of slightly spaced apart, annular rows of teeth 51. The diameter of the shaft 50 in the teeth area is larger than the diameter of the shafts 28 and 45. Accordingly, the shaft 50 must be inserted into the slightly wider middle portion of the socket 25 (FIG. 11). When the screw 33 is tightened the teeth 51 engage the splines 30 in the socket 25 in such middle area. Because the teeth 5 are wide and relatively shallow, i.e. do not extend a great distance outwardly from the shaft 50, the grooves 52 in the sides of the socket 25 are wide and shallow. Moreover, small projections 54 (FIG. 5) are provided in two opposed grooves 52, i.e. the outermost surfaces of the grooves are somewhat convex for maximum contact with the splines 30 in the socket 25. Such a structure ensures a tight fit between the body 1 and shaft 50, and prevents movement of the shaft 50 relative to the body 1 once the screw 33 has been tightened.

Figure 12:
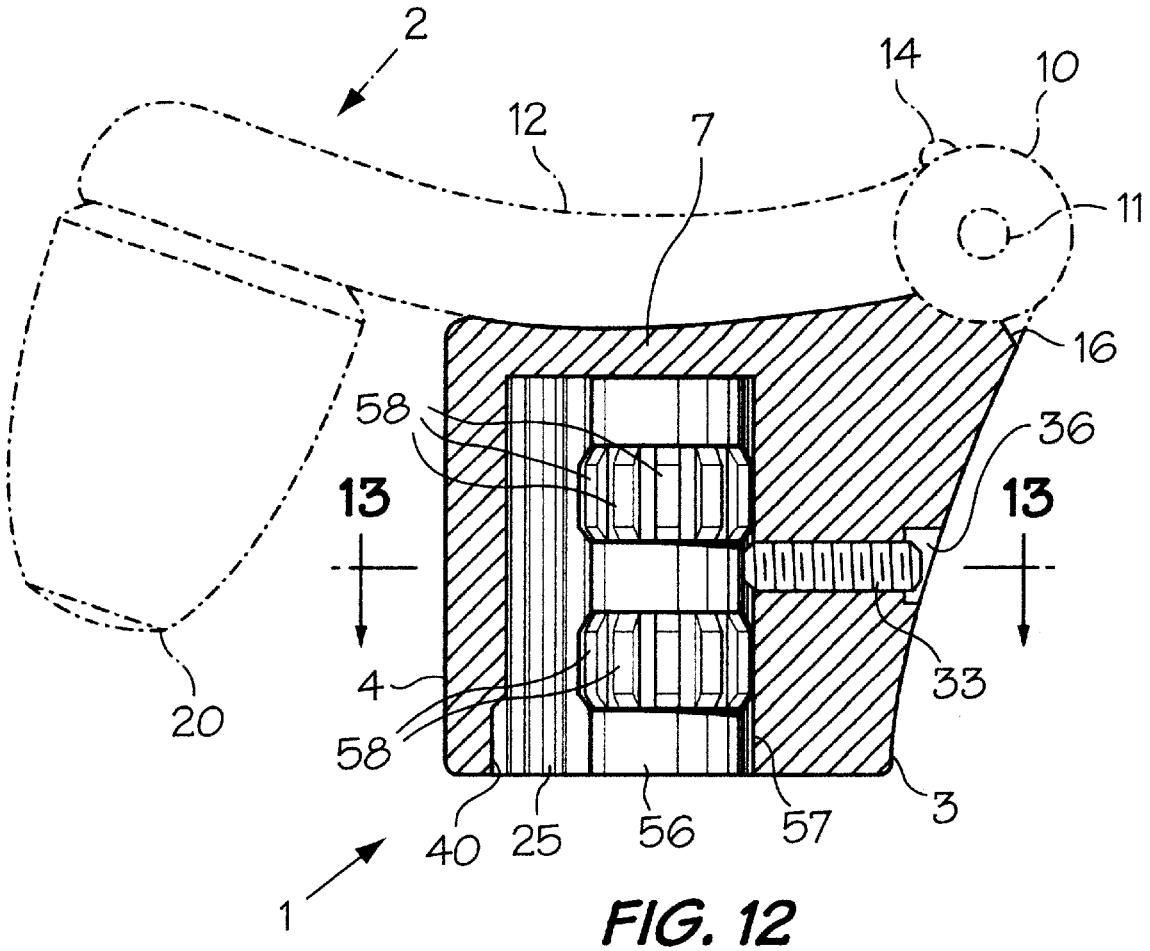
Figure 13:
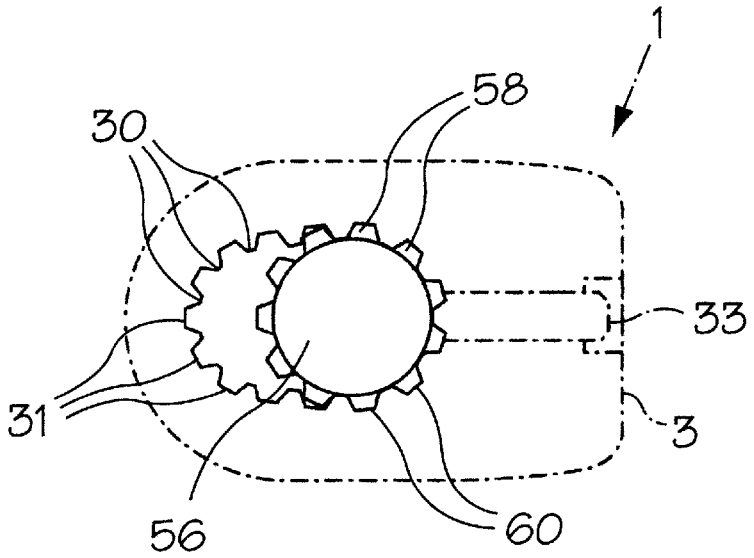

Referring to FIGS. 12 and 13, a fourth type of currently available shaft 56 has a relatively large diameter, permitting insertion of the shaft into the wide end 57 (FIGS. 5 and 12) of the ovoid socket 25. The shaft 56 includes relatively long, wide teeth 58 extending a short distance outwardly from the shaft in two parallel, spaced apart, annular rows. Thus, when the shaft 56 is slid into the wide end 57 of the socket 25, the teeth 58 fully engage the sides of wide, shallow grooves 60 (FIGS. 5 and 13) in such wide end 57 of the socket.

Figure 14:
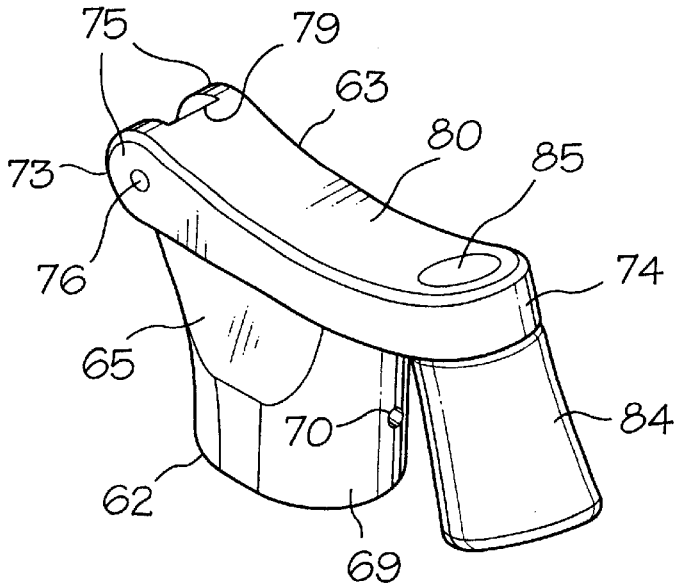
FIG. 14 is a perspective view of a second embodiment of the crank assembly of the present invention with a handle portion thereof in the non-use position.
Figure 15:
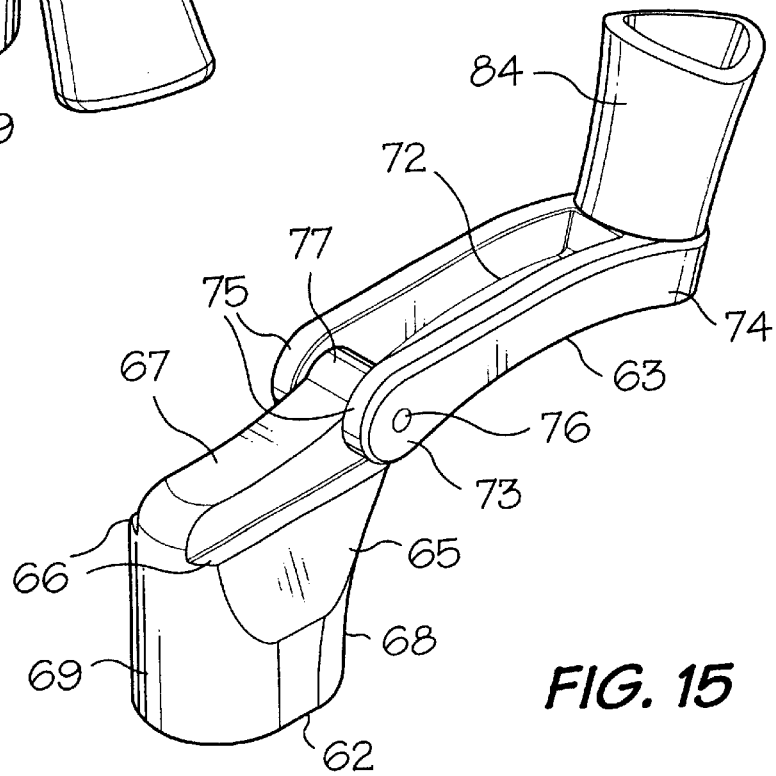
FIG. 15 is a perspective view of the crank assembly of FIG. 14 with the handle in the use position.
Figure 16:
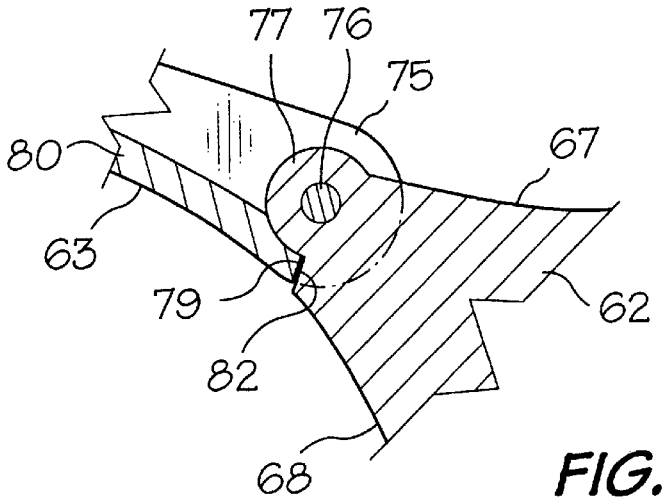
FIG. 16 is a longitudinal sectional view of one corner of the body and handle of FIGS. 14 and 15.

With reference to FIGS. 14 and 15, a second embodiment of the invention includes a body 62, which is similar in cross section to the body 1, and an arcuate handle 63. In the second embodiment of the invention, the sides 65 of the body slope upwardly and inwardly to roughly square shoulders 66 on each side of a rectangular cross section ridge 67. The ridge 67 extends the entire length of the top end of the body 62 between a square end 68 and a generally semicylindrical end 69 of the body. In this case, the handle 63 includes a trough 70 extending substantially the entire length thereof between an open inner end 72 and a closed outer end 74. The trough 72 is complementary to the ridge 67, i.e. borders the ridge when the handle 63 is in the folded, non-use position (FIG. 14). A pair of generally circular ears 75 are provided at the open inner end 73 of the trough 70 for receiving a pin 76 which pivotally connects the handle 63 to a cylindrical end 77 of the ridge 67. The ears 75 extend beyond the inner end 79 of the top wall 80 of the handle 63. When the handle 63 is rotated to the extended, use position, such inner end 79 abuts a flat shoulder 82 (FIG. 16) on the square end of the body 62, i.e. the surface 82 acts as a stop to limit rotation of the handle 63 relative to the body 62.

A hollow knob 84 with a closed top end (not shown) is rotatably mounted on the bottom of the outer end of the handle 63 by means of a bolt 85. As best shown in FIG. 15, the knob 84 has a generally triangular cross section with rounded corners to facilitate manual manipulation of the knob.

As in the case of the first embodiment of the invention, when the handle 63 is in the use position, there is maximum contact between the bracket defined by the ears 75 and the cylindrical end 77 of the body 62. In the folded, non-use position, the handle 63 overlaps the top end of the body 62, so that the assembly is compact, streamlined and unobtrusive.

It will be appreciated that the ovoid socket 25 can be used in virtually any crank assembly for operating a casement window, e.g. in crank assemblies including non-foldable handles. Moreover, the specific foldable handle and body structures described above can be used in crank assemblies in which the socket is circular in cross-section. Thus. both the ovoid socket and the particular foldable handle arrangements are believed to be novel.

I claim:

1. A crank assembly for use on a splined shaft operable to open and close a casement window comprising a tubular body having a closed top end and an open bottom end; a socket in said open bottom end for mounting the body on the splined shaft; said socket being ovoid in cross section, and including alternating, longitudinally extending splines and grooves for operably connecting the body to any of a plurality of splined shafts having a variety of diameters and spline configurations; a handle pivotal on one corner of said top end for rotation between an extended position in which the handle extends outwardly from the body for rotating the body and the splined shaft to open and close the window, and a stored position in which the handle extends across the top of the body, one of the top end of the body and the handle defining a trough or ridge; and the other said top end of the body or the handle defining a complementary ridge or trough, whereby in the stored position, with the trough and ridge mating, the bottom edge of the handle lies beneath the top end of the body; and a knob on a free end of said handle, in the stored position, the knob being spaced apart from one end of the body for facilitating manual access to the knob and rotation of the handle to the extended, use position for rotating the body and the shaft.

2. The crank assembly of claim 1, wherein said ovoid socket includes a wide end and a narrow end, selected of said splines and grooves in said narrow end including longitudinally extending shoulders for accommodating shafts having low splines and shallow grooves.

3. The crank assembly of claim 1, including a cylindrical end on said handle; a pair of spaced apart flanges extending upwardly from the top end of said body defining said trough, the trough extending the entire length of said top end of the body and tapering from one end to the other end of said top end, at one end said flanges being generally semicircular; and a concave depression extending across the top end of the body between said semicircular ends, said semicircular ends and said depression defining a cylindrical bracket for pivotally receiving said cylindrical end of said handle.

4. The crank assembly of claim 3, including a projection on said cylindrical end of said handle for limiting rotation of the handle in said cylindrical bracket.

5. The crank assembly of claim 1, including a rectangular cross section top end on said body, said top end tapering along its entire length; and a complementary trough in said handle for seating on said top end when the handle is in the stored position, one end of said rectangular top end being cylindrical for pivotally supporting circular ends on the sides of said trough.

6. A crank assembly for use on a splined shaft operable to open and close a casement window comprising a tubular body having a closed top end and an open bottom end; an ovoid socket in said open bottom end for mounting the body on the splined shaft, said socket including alternating splines and grooves for operably connecting the body to any of a plurality splined shafts having a variety of diameters and spline configurations; and a handle extending outwardly from one corner of said top end for rotating said body and the splined shaft to open and close a window.

7. The crank assembly of claim 6, wherein said ovoid socket includes a wide end and a narrow end, selected of said splines and grooves in said narrow end including longitudinally extending shoulders for accommodating shafts having low splines and shallow grooves.

8. The crank assembly of claim 6 including a pair of spaced apart flanges extending upwardly from the top end of said body, the trough extending the entire length of said top end of the body and tapering from one end to the other of said body, a bracket at one end of said flanges for pivotally receiving one end of said handle, whereby said handle can be rotated between an extended position in which the handle extends outwardly form the body for rotating the body and the splined shaft to pen and close the window, and a stored position in which the handle extends across the top of the body in said trough.

* * * * *